US007085354B2

(12) United States Patent
Kanagami

(10) Patent No.: US 7,085,354 B2
(45) Date of Patent: Aug. 1, 2006

(54) X-RAY TUBE APPARATUS

(75) Inventor: Masaji Kanagami, Utsunomiya (JP)

(73) Assignees: Toshiba Electron Tube & Devices Co., Ltd., Otawara (JP); Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/933,530

(22) Filed: Sep. 3, 2004

(65) Prior Publication Data

US 2005/0025284 A1 Feb. 3, 2005

Related U.S. Application Data

(63) Continuation of application No. PCT/JP2004/000461, filed on Jan. 21, 2004.

(30) Foreign Application Priority Data

Jan. 21, 2003 (JP) ..... 2003-012194

(51) Int. Cl.
*H01J 35/06* (2006.01)

(52) U.S. Cl. ..... 378/136; 378/134; 378/138
(58) Field of Classification Search ..... 378/113, 378/134, 136–138
See application file for complete search history.

(56) References Cited

U.S. PATENT DOCUMENTS

| | | | | |
|---|---|---|---|---|
| 4,065,689 | A * | 12/1977 | Pleil | 378/134 |
| 4,685,118 | A * | 8/1987 | Furbee et al. | 378/114 |
| 5,303,281 | A * | 4/1994 | Koller et al. | 378/134 |
| 5,623,530 | A * | 4/1997 | Lu et al. | 378/136 |
| 6,333,969 | B1 * | 12/2001 | Kujirai | 378/138 |

FOREIGN PATENT DOCUMENTS

| | | |
|---|---|---|
| JP | 52-116172 | 9/1977 |
| JP | 59-134363 | 9/1984 |
| JP | 61-179045 | 8/1986 |
| JP | 6-290721 | 10/1994 |
| JP | 10-241613 | 9/1998 |
| JP | 2002-83560 | 3/2002 |

* cited by examiner

*Primary Examiner*—Edward J. Glick
*Assistant Examiner*—Thomas R. Artman
(74) *Attorney, Agent, or Firm*—Oblon, Spivak, McClelland, Maier & Neustadt, P.C.

(57) ABSTRACT

This invention provides an X-ray tube apparatus which can output X-rays of a dose suitable for radioscopy for a long time. In the apparatus, small focus filaments are provided on respective sides of a large focus filament, such that they have almost equal distances from the center of the large focus filament, and the inclination angles of converging electrodes surrounding the respective small focus filaments with respect to a cathode main body are set to almost equal angles within a range of 20 to 40°.

9 Claims, 2 Drawing Sheets

X-RAY TUBE APPARATUS

CROSS-REFERENCE TO RELATED APPLICATIONS

This is a Continuation Application of PCT Application No. PCT/JP2004/000461, filed Jan. 21, 2004, which was published under PCT Article 21(2) in Japanese.

This application is based upon and claims the benefit of priority from prior Japanese Patent Application No. 2003-012194, filed Jan. 21, 2003, the entire contents of which are incorporated herein by reference.

BACKGROUND OF THE INVENTION

1. Field of the Invention

This invention relates to an X-ray tube apparatus which can output X-rays of a dose suitable for radioscopy for a long time.

2. Description of the Related Art

In fields of medical diagnosing apparatuses and non-destructive testing apparatuses, X-rays are widely used in obtaining an image of an object to be tested, that is, an object of a photograph. If, for example, a still picture of X-ray image of an object is to be obtained, intensifying screens and films are mainly used. If, for example, moving image information is to be obtained, an X-ray image tube (X-ray detector) is used.

These days, in a method of imaging an object by using an X-ray image tube, two filaments having different focuses are used, and X-rays of a radioscopic dose with a small focus are applied to the object to obtain moving image information thereof. In the meantime, a method is widely used in which X-rays of a large dose with a large focus for still pictures are applied to the object to obtain a still picture thereof, under specific conditions or in the screen a picture of which is to be obtained.

For example, Jpn. Pat. Appln. KOKAI Pub. No. 2002-83560 has already proposed a rotating anode X-ray tube having a filament 21*a* with a large focus and a filament 21*b* with a small focus.

Further, Jpn. Pat. Appln. KOKAI Pub. No. 6-290721 has already proposed a rotating anode X-ray tube, in which two filaments 3 are provided on respective focusing grooves 7 with an anchor 4 interposed therebetween.

These days, when moving images of the object are obtained by applying X-rays of a radioscopic dose with a small focus by using the above X-ray image tube, it is desired to obtain an image having a maximum resolution even in moving images.

However, when a current supplied to the filament of a small focus is increased to provide a radioscopic dose, there is the problem that the operation temperature of the filament rises and thereby the life of the filament is sharply shortened.

This increases the running cost of the medical diagnosing apparatuses and non-destructive testing apparatuses into which the X-ray tube is integrated, since it is required to change the X-ray tube before the filament of the large focus for still pictures reaches an end of its life. In particular, in medical diagnosing apparatuses, there are cases where it is impossible to suspend the test and to take a waiting time, and the problem cannot be solved by simply changing the filament (or X-ray tube apparatus).

BRIEF SUMMARY OF THE INVENTION

The object of the present invention is to provide an X-ray tube apparatus which can output X-rays of a dose suitable for radioscopy for a long time, when moving image of an object is obtained by applying X-rays of a radioscopic dose with a small focus.

The present invention has been made to solve the above problem, and to provide an X-ray tube an X-ray tube apparatus comprising: an anode which radiates X-rays; and an electron gun having filaments which emit thermoelectrons to collide with the anode, and converging electrodes which converge the respective thermoelectrons emitted by the filaments and form respective focuses in a predetermined position of the anode, wherein the filaments are at least two, and the at least two filaments are arranged in diagonal positions from a most deepest position in a depth direction of a concave portion provided on a cathode main body which forms the electron gun.

DETAILED DESCRIPTION OF THE INVENTION

An embodiment of the present invention will now be explained with reference to drawings.

Figure 1:
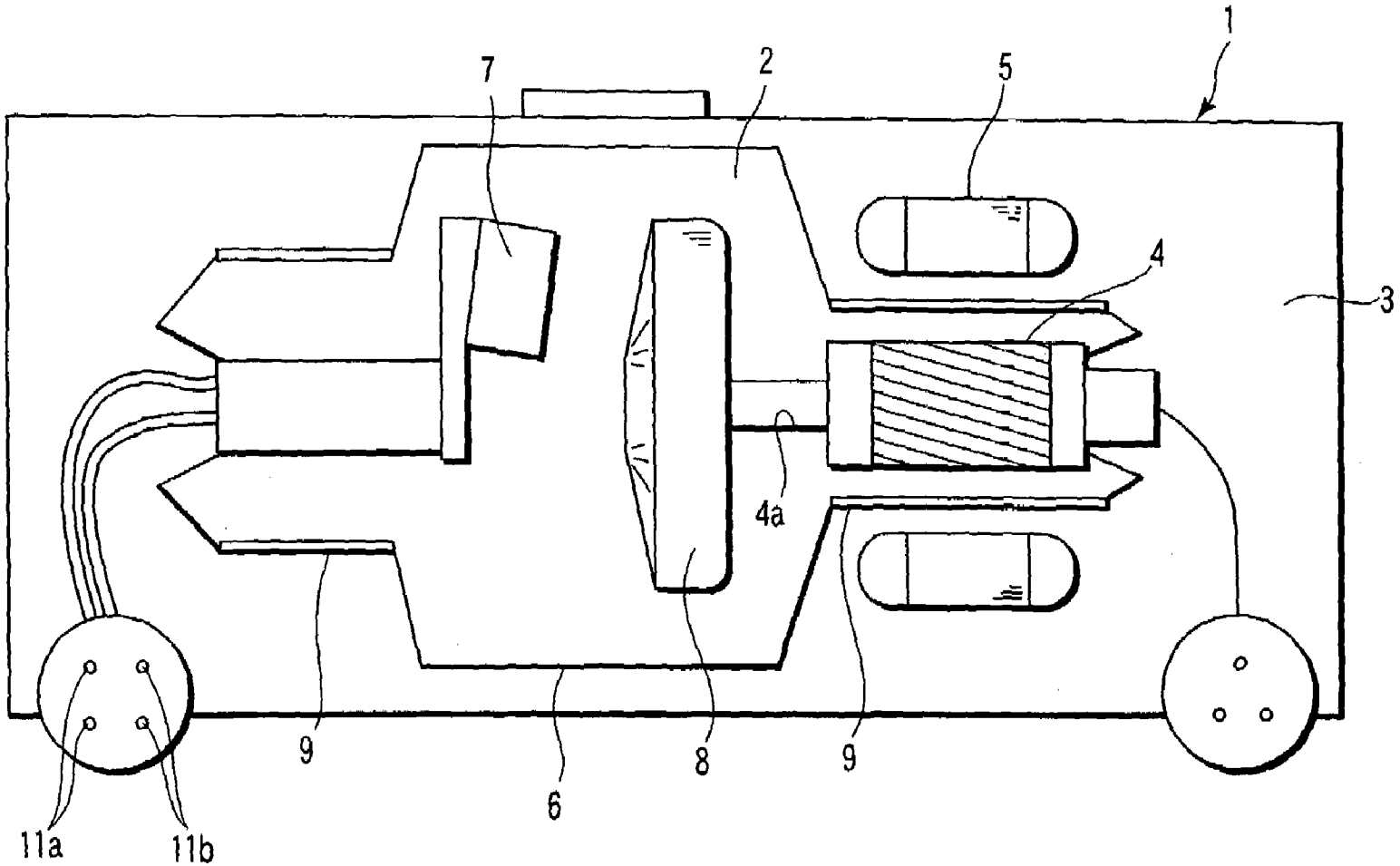
FIG. 1 is a schematic diagram illustrating an example of an X-ray tube apparatus to which an embodiment of the present invention is applicable.

As shown in FIG. 1, an X-ray tube apparatus 1, which is provided to allow an X-ray radioscopic image to be projected onto an X-ray image tube for detecting an X-ray image, has an X-ray tube main body 2 which can radiate X-rays of a predetermined wavelength and a predetermined intensity to a predetermined direction. The X-ray tube apparatus 1 is filled with an insulating oil 3 which airtightly holds the X-ray tube main body 2. Further, in a predetermined position of the X-ray tube apparatus 1, provided is a stator 5 for applying thrust (magnetic field) to a rotary mechanism 4 provided inside the X-ray tube main body 2.

In predetermined positions inside an envelope 6 of the X-ray tube main body 2, a cathode electrode gun 7 which emits thermoelectrons, and an anode 8 which radiates X-rays by collision of the thermoelectrons (from the cathode electron gun 7). The cathode electron gun 7 and the anode 8 are insulated from each other by an insulating material 9. Further, the anode 8 is fixed on a rotation axis 4*a* of the rotary mechanism (rotor) 4, and rotated at a predetermined speed by rotation of the rotor 4.

Figure 3:
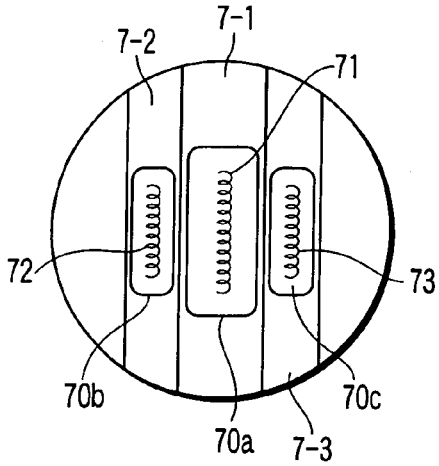
FIG. 3 is a plan view of the filaments and the converging electrodes of the electron gun shown in FIG. 2.
Figure 2:
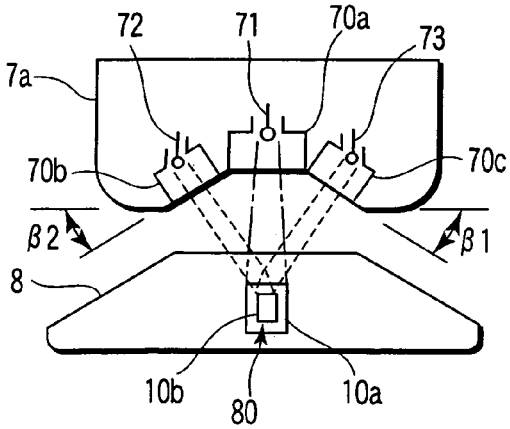
FIG. 2 is a schematic diagram illustrating an example of relationship between filaments and converging electrodes of a cathode electron gun and a focus position of an anode in the X-ray tube apparatus shown in FIG. 1.

As shown in FIGS. 2 and 3, the cathode electron gun 7 includes a first filament 71, and a second filament 72 and a third filament 73. The first filament 71 can collide thermoelectrons against a predetermined position of the anode 8, that is, a focus position 80, with a large focus 10*a*. The second and third filaments 72 and 73 can collide thermoelectrons against the focus position 80 with a small focus 10*b*. A cathode main body 7*a* has a structure where a whole region in which the first to third filaments are provided is concaved, and the first filament 71 and a first converging electrode 70*a* are held in the most recessed position. A cathode current of a predetermined magnitude is inputted to the first filament 71 according to the first focus position 10*a*, and to the second and third filaments 72 and 73 according to the second focus position 10*b*.

The first to third filaments 71 to 73 are positioned in the practical center of the first to third converging electrodes 70*a* to 70*c*, respectively, which surround the respective filaments.

Each of the converging electrodes 70*a* to 70*c* has a rectangular shape, for example, such that a main part of the cathode electron gun 7, that is, a part of the cathode main body 7*a* enclose the filaments in its respective groove recessed portions (filament and converging electrode receiving portions) 7-1, 7-2 and 7-3. Further, the second and third converging electrodes 70*b* and 70*c* which cover the second and third filaments 72 and 73, respectively, are provided on respective sides of the first converging electrode 70*a*, in diagonal positions from the center of the first converging electrode 70*a* (filament 71) (they are provided in respective positions defined by the groove concave positions 7-2 and 7-3).

An angle $\beta_1$ is an angle which a plane including an edge defined by an open end of the second converging electrode 70*b*, that is, by a concave portion of the converging electrode 70*b* and the surface of the cathode main body 7*a* forms with a plane including a portion of the surface of the cathode main body 7*a* which is more projected than all the converging electrodes (hereinafter referred to as an inclination angle of the converging electrode 70*b* for the first small focus filament). The angle $\beta_1$ is set to fall within the range of 20 to 40°. Thermoelectrons emitted from the filament travel along an arc from the converting electrode to the anode. Therefore, if the distance between the converging electrode and the anode is long, the angle of the inclination surface should be set sharp and, if the distance is short, the angle should be set wide, in order to superpose the focuses of the filaments on each other on the anode.

In the meantime, the distance between the converging electrodes and the anode is set to a minimal distance required to avoid high-voltage electrical breakdown due to the voltage applied to the X-ray tube. For example, in the medical diagnosing X-ray tube, the distance is usually set to 13 to 18 mm. In respect of avoiding high-voltage dielectric breakdown, it is more advantageous to set the distance long. However, if the distance is long, the arrival rate of the thermoelectrons from the filaments to the anode decreases, and a problem of decrease in the tube current property is caused (a required current cannot be obtained unless the filament current is excessively increased, and thereby the filament life is shortened).

Therefore, generally the distance between each converging electrode and the anode is set to a proper distance which satisfies the conflicting properties, that is, the high-voltage insulating property and the tube current property. Supposing that the distance falls within the above range of 13 to 18 mm, the inclination angle is required to fall within 20 to 40° specified in the present invention, to superpose the small focuses, formed by the two converging electrodes arranged on inclined surfaces, on each other on the anode. The inclination angle is changed according to the setting distance between the converging electrodes and the anode and the size of the small focus converging electrodes. The inclination angle is preferably set as sharp as possible, since a sharper angle is more advantageous in respect of the tube current property.

In the same manner, an angle $\beta_2$ is an angle which a plane including an edge defined by a concave portion of the third converging electrode 70*c* and the surface of the cathode main body 7*a* forms with a plane including a portion of the surface of the cathode main body 7*a* which is more projected than all the converging electrodes (hereinafter referred to as an inclination angle of the converging electrode 70*c* for the first small focus filament). The angle $\beta_2$ is set to fall within the range of 20 to 40°. It is needless to say that the inclination angles $\beta_1$ and $\beta_2$ are preferably set practically equal to each other.

As described above, in the X-ray tube apparatus of the present invention, the two small focus filaments 72 and 73 are provided on respective sides of the large focus filament 71, and in respective diagonal positions from the center of the large focus filament 71. Further, the inclination angles of the converging electrodes 70*b* and 70*c* surrounding the respective small focus filaments with respect to the cathode main body 7*a* are equally set to an angle within the range of 20 to 40°.

Thereby, if the two small-focus filaments 72 and 73 are simultaneously energized, thermoelectrons emitted from the small focus filaments are entirely superposed on each other on the focus position 80 of the anode 8. Specifically, the thermoelectrons from the two small-focus filaments are accurately collided with the focus position 80 of the anode 8, without increase in the effective focus size on the focus position 80.

Further, although a large radioscopic current is obtained by simultaneously energizing the two small focus filaments 72 and 73, it has been verified that the magnitude of the heating current flowing through each filament is reduced to be lower than a rated value, and that the life of each of the filaments 72 and 73 is increased to about 10 times as long as the life of a single small focus filament supplied with a heating current exceeding the rated value.

If the large focus filament 71 and the two small focus filaments 72 and 73 are provided, it is important to provide the large focus filament 71 and the corresponding converging electrode 70*a* in the center of the cathode main body 7*a* of the cathode 7, and in the deepest portion in the depth direction of the concave portion of the cathode main body 7*a*.

Specifically, it has been verified by experiments that, if the large focus filament 71 and the two small focus filaments 72 and 73 are provided in the single cathode main body 7*a* and the large focus filament 71 is not provided between the two small focus filaments 72 and 73, the thermoelectrons radiated from the two small focus filaments are not securely superposed on the focus position 80 of the anode 8, owing to the electric fields of converging electrode 70*a* surrounding the large focus filament 71 and the other converging electrodes 70*b* and 70*c* (which surround the respective small focus filaments).

Further, in the above X-ray tube apparatus, explained is the case where the two small focus filaments are provided on respective sides of the large focus filament and the small focus filaments are simultaneously energized. However, if it is unnecessary to energize the small focus filaments simultaneously, the heating current can be alternately supplied to one of the small focus filaments, by providing, for example, a changeover switch to a second electrode 11*b*. This can increase the life of the filaments at least about twice as long as the life thereof in the case of using a single filament.

Figure 5:
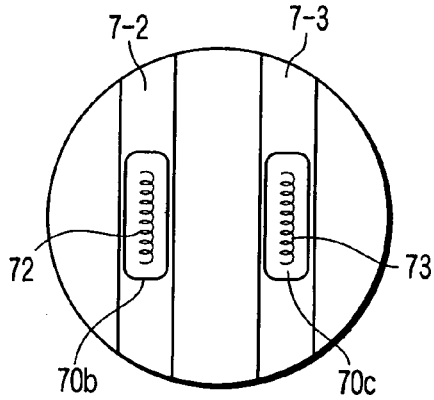
FIG. 5 is a plan view of the filaments and the converging electrodes of the cathode electron gun shown in FIG. 4.
Figure 4:
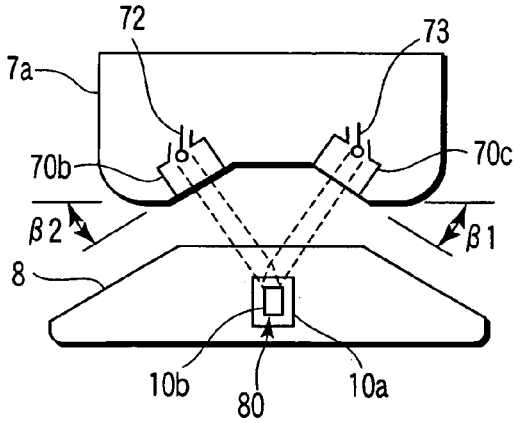
FIG. 4 is a schematic diagram illustrating an example of a modification applicable to the filaments and the converging electrodes of the cathode electron gun in the X-ray tube apparatus shown in FIG. 1.

FIGS. 4 and 5 illustrate an example of a modification of the X-ray tube apparatus shown in FIGS. 2 and 3.

As shown in FIGS. 4 and 5, two small focus filaments 72 and 73 to which almost equal heating currents can be supplied, that is, which have almost equal output X-ray doses, may be provided on a cathode main body 7*a* of a cathode 7, in positions having a predetermined distance from the center of a concave portion of the cathode main body 7*a*, such that the small focus filaments are arranged in diagonal positions with respect to a focus position 80 of an anode 8.

The inclination angles of converging electrodes 70*b* and 70*c* surrounding the respective filaments 72 and 73 can be set to a range of 20 to 40°, as explained above with reference to FIGS. 2 and 3. In such a case, as explained above, the focuses of thermoelectrons radiated from the two small focus filaments 72 and 73 towards the focus position 80 of the anode 8 (to be collided with the anode) can be accurately superposed on each other, without being undesirably increased in size, by setting the above inclination angles to the range of 20 to 40°.

Therefore, by optimizing the magnitude of the heating current supplied to each of the filaments 72 and 73, that is, the quantity of thermoelectrons radiated by each of the filaments 72 and 73, the quantity of thermoelectrons radiated from the filaments when the heating current is simultaneously supplied to the filaments can be set almost equal to the quantity of thermoelectrons radiated from a well-known large focus filament. Therefore, the filaments 72 and 73 can also serve as a well-known large focus filament.

The present invention is not limited to the embodiments described above and can be modified in various manners without departing from the spirit and scope of the invention. The embodiments may appropriately be combined as much as possible. In this case, an effect by the combination can be obtained.

As described above, according to the present invention, it is possible to output X-rays of a dose suitable for radioscopy for a long time in an X-ray tube apparatus. In such a case, X-rays of a dose suitable for radioscopy can be easily obtained by supplying a heating current less than a rated value to a corresponding filament. Therefore, the life of the filaments is increased, and suspension of test is prevented.

According to the present invention, it is possible to obtain an X-ray tube apparatus which can output X-rays of a dose suitable for radioscopy for a long time, when moving images of an object are to be obtained by applying X-rays of a radioscopic dose with a small focus.

What is claimed is:

1. An X-ray tube apparatus comprising:

an anode which radiates X-rays; and a cathode electron gun comprising, a cathode main body having a concave portion, at least first, second and third filaments which emit thermoelectrons to collide with the anode, and at least first, second and third respective converging electrodes which converge the respective thermoelectrons emitted by the first, second and third filaments and form respective focuses in a predetermined position of the anode, said at least first, second and third filaments and said at least first, second and third converging electrodes disposed within said concave portion, said first filament being a large focus filament and said second and third filaments being small focus filaments, said first filament and said first converging electrode corresponding to the first filament being provided in a deepest position in a depth direction of said concave portion, and said second and third filaments and said respective second and a third converging electrodes being provided on respective inclined surfaces of the concave portion, wherein the second and third converging electrodes are provided at equal inclination angles on inclined surfaces of the concave portion of the cathode main body, wherein said inclination angles of said inclined surfaces, defined as angles between planes including open end edges of each of the second and third converging electrodes and a plane including surfaces of the cathode main body more projected than all the converging electrodes, fall within a range of 20 to 40°, and wherein the small focus filaments can be simultaneously energized.

2. An X-ray tube apparatus comprising:

an anode which radiates X-rays; and a cathode electron gun comprising, a cathode main body having a concave portion, at least first, second and third filaments which emit thermoelectrons to collide with the anode, and at least first, second and third respective converging electrodes which converge the respective thermoelectrons emitted by the first, second and third filaments and form respective focuses in a predetermined position of the anode, said at least first, second and third filaments and said at least first, second and third converging electrodes disposed within said concave portion, said first filament being a large focus filament and said second and third filaments being small focus filaments, said first filament and said first converging electrode corresponding to the first filament being provided in a deepest position in a depth direction of said concave portion, and said second and third filaments and said respective second and a third converging electrodes being provided on respective inclined surfaces of the concave portion, wherein the small focus filaments and the respective corresponding converging electrodes are provided at equal angles on the inclined surfaces of the concave portion of the cathode main body.

3. An X-ray tube apparatus comprising:

an anode which radiates X-rays; and a cathode electron gun comprising, a cathode main body having a concave portion, at least first, second and third filaments which emit thermoelectrons to collide with the anode, and at least first, second and third respective converging electrodes which converge the respective thermoelectrons emitted by the first, second and third filaments and form respective focuses in a predetermined position of the anode, said at least first, second and third filaments and said at least first, second and third converging electrodes disposed within said concave portion, said first filament being a large focus filament and said second and third filaments being small focus filaments, said first filament and said first converging electrode corresponding to the first filament being provided in a deepest position in a depth direction of said concave portion, and said second and third filaments and said respective second and a third converging electrodes being provided on respective inclined surfaces of the concave portion, wherein the second and third converging electrodes are provided at equal inclination angles on the inclined surfaces of the concave portion of the cathode main body, wherein said inclination angles of said inclined surfaces, defined as angles between planes including open end edges of each of the second and third converging electrodes and a plane including surfaces of the cathode main body more projected than all the converging electrodes, fall within a range of 20 to 40°, and wherein the small focus filaments and the respective corresponding converging electrodes are provided at equal angles on the inclined surfaces of the concave portion of the cathode main body.

4. An X-ray tube apparatus comprising:

a rotary anode which is rotated at a predetermined speed;

an electron gun having a cathode main body including a large focus first filament, a small focus second filament, a small focus third filament, each of which emit thermoelectrons to collide with the anode, converging electrodes which surround the respective filaments, converge the thermoelectrons emitted by the respective filaments and form respective focuses in a predetermined position of the rotary anode, and first to third groove recessed portions which hold the respective converging electrodes and the respective corresponding filaments; and a power source connecting section to supply a heating current to each of respective filaments of the electron gun, wherein the first groove recessed portion which holds the first filament and the first converging electrode is formed in a deepest position in a depth direction of a concave portion of the cathode main body, and the second groove recessed portion which holds the second filament and the second converging electrode and the third groove recessed portion which holds the third filament and the third converging electrode are arranged on respective sides of the first groove recessed portion at equal angles from the first groove recessed portion.

5. An X-ray tube apparatus according to claim 4, wherein the second and third filaments are operated by a heating current which is less than a rated current.

6. An X-ray tube apparatus according to claim 4, wherein the second and third converging electrodes are provided at equal inclination angles on the sides of the concave portion of the cathode main body, wherein said inclination angles, defined as angles between planes including open end edges of each of the second and third converging electrodes and a plane including surfaces of the cathode main body more projected than all the converging electrodes, fall within a range of 20 to 40°.

7. An X-ray tube apparatus according to claim 6, wherein the second and third filaments are operated by a heating current which is less than a rated current.

8. An X-ray tube apparatus according to claim 4, wherein the second filament and the second converging electrode and the third filament and the third converging electrode are provided at equal angles on inclined surfaces of the first groove recessed portion of the cathode main body.

9. An X-ray tube apparatus according to claim 8, wherein the second and third filaments can be simultaneously energized.

* * * * *